United States Patent [19]

Durr et al.

[11] Patent Number: 5,066,151

[45] Date of Patent: Nov. 19, 1991

[54] DEVICE COMPRISING A PRINTING MECHANISM

[75] Inventors: Heinrich Durr, Wilnsdorf-Niederdielfen; Manfred Rosenthal, Kirchen-Freusburg; Manfred Adamek, Kirchen(Sieg)-Struth, all of Fed. Rep. of Germany

[73] Assignee: U.S. Philips Corporation, New York, N.Y.

[21] Appl. No.: 487,677

[22] Filed: Mar. 1, 1990

[30] Foreign Application Priority Data

Mar. 2, 1989 [DE] Fed. Rep. of Germany ..... 3906612

[51] Int. Cl.[5] ..... B41J 11/50

[52] U.S. Cl. ..... 400/605; 400/625; 400/642; 271/303

[58] Field of Search ..... 400/605, 616, 616.1, 400/616.2, 624, 625, 629, 636, 636.1, 637, 642, 647.1; 271/3, 9, 303; 226/101

[56] References Cited

U.S. PATENT DOCUMENTS

| | | | |
|---|---|---|---|
| 3,416,863 | 12/1968 | Ralston | 271/303 |
| 4,452,543 | 6/1984 | Adkisson et al. . | |
| 4,569,468 | 2/1986 | Neer . | |
| 4,688,957 | 8/1987 | Prevignano | 400/604 |
| 4,789,258 | 12/1988 | Gomoll et al. | 400/604 |
| 4,929,104 | 4/1990 | Yokoi | 400/605 |

FOREIGN PATENT DOCUMENTS

| | | | |
|---|---|---|---|
| 0027859 | 5/1981 | European Pat. Off. | 400/605 |
| 0258026 | 3/1988 | European Pat. Off. | 400/605 |
| 2855253 | 7/1980 | Fed. Rep. of Germany . | |
| 3541550 | 5/1987 | Fed. Rep. of Germany | 400/605 |
| 3630782 | 3/1988 | Fed. Rep. of Germany | 400/605 |
| 3807807 | 9/1989 | Fed. Rep. of Germany . | |
| 0180867 | 9/1985 | Japan | 400/605 |
| 0291159 | 12/1986 | Japan | 400/605 |

*Primary Examiner*—Eugene H. Eickholt
*Attorney, Agent, or Firm*—William Squire

[57] ABSTRACT

A printing mechanism is preceded by a single feeding region for separate papers and endless papers. The feeding region comprises an inlet duct for manually feeding separate papers, a tractor for the transport of endless papers arranged fixedly under the inlet duct and at least one cassette for automatically feeding separate papers. The cassette is detachably arranged above the inlet duct and is inclined obliquely forwards.

19 Claims, 2 Drawing Sheets

DEVICE COMPRISING A PRINTING MECHANISM

The invention relates to a device, comprising a printing mechanism, means for transporting paper sheets by driving rollers and means for transporting endless paper by a tractor. A device of the kind mentioned above, i.e. an office machine is described, for example, in German Patent Application P 3807807. In the construction described, the tractor is situated behind the printing roller and is pivotably arranged so as to operate either in the pushing or in the pulling position.

Of interest are commonly owned copending applications Ser. No. 487,674 filed Mar. 1, 1990 entitled "Device for Adjustment of a Printer," Ser. No. 317,376 filed Mar. 1, 1989 entitled "Office Machine," and Ser. No. 317,378 entitled "Office Machine" all in the name of M. Rosenthal and Ser. No. 321,620 filed Mar. 9, 1990 in the name of Durr et al.

The invention has for its object to provide a device of the kind mentioned above, in which several kinds of papers can be supplied in a simple manner without much effort being required for changing over from one kind of paper to the other. According to the invention, this object is achieved in that the printing mechanism is preceded by a single feeding region for paper sheets and endless paper, having an entrance for manually feeding paper sheets, a tractor for the transport of endless paper arranged fixedly under the entrance and at least one cassette for automatically feeding paper sheets, which cassette is detachably arranged above the entrance and is inclined obliquely forwards. Thus, paper can be fed to the printing mechanism along three different paths, which are joined to form one single path before the driving rollers arranged in front of the printing mechanism. This common path is maintained until the first pair of rollers arranged behind the printing mechanism is passed. It is not until then that the paper paths for paper sheets and endless paper are separated. An ergonomically favourable operation becomes possible due to the oblique arrangement of the feeding cassettes. Further, due to the oblique arrangement in the feeding region, a sufficiently large space is obtained under the cassettes so that without any problem paper sheets can be fed by hand into the entrance thus formed. In order that endless forms can be introduced into the tractors arranged under the entrance, the supporting plate for manual feeding in the entrance can be removed. Due to the rectilinear transport of all kinds of paper, a relative displacement of copies or a bulging due to the different radii of curvature is avoided. Different kinds of paper can be processed without exchange or removal of a function unit upon change of the modes of operation. The magazines, i.e. cassettes for paper sheets, arranged obliquely towards the operator in an ergonomically favourable position in an adjacent area permit an easy and readily controllable filling without it being required to enlarge the magazines.

The stacker for the paper sheets is preferably located on the upper side of the office machine behind the printing mechanism and is likewise inclined obliquely forwards. Due to the fact that both the cassettes and the stacker for the paper sheets and the longitudinal axis of the printing mechanism are arranged as far as possible in parallel forwardly inclined planes, a simple operation of the whole apparatus is obtained. Further, the cassettes, the printing mechanism and the stacker are preferably arranged with respect to each other in such a manner that paper paths are obtained which extend substantially obliquely upwards. Thus, there is sufficient room in the hindmost lower region of the office machine for the electronic systems and other devices.

FIGS. 1 and 2 of the drawing show an embodiment of the article according to the invention.

Figure 1:
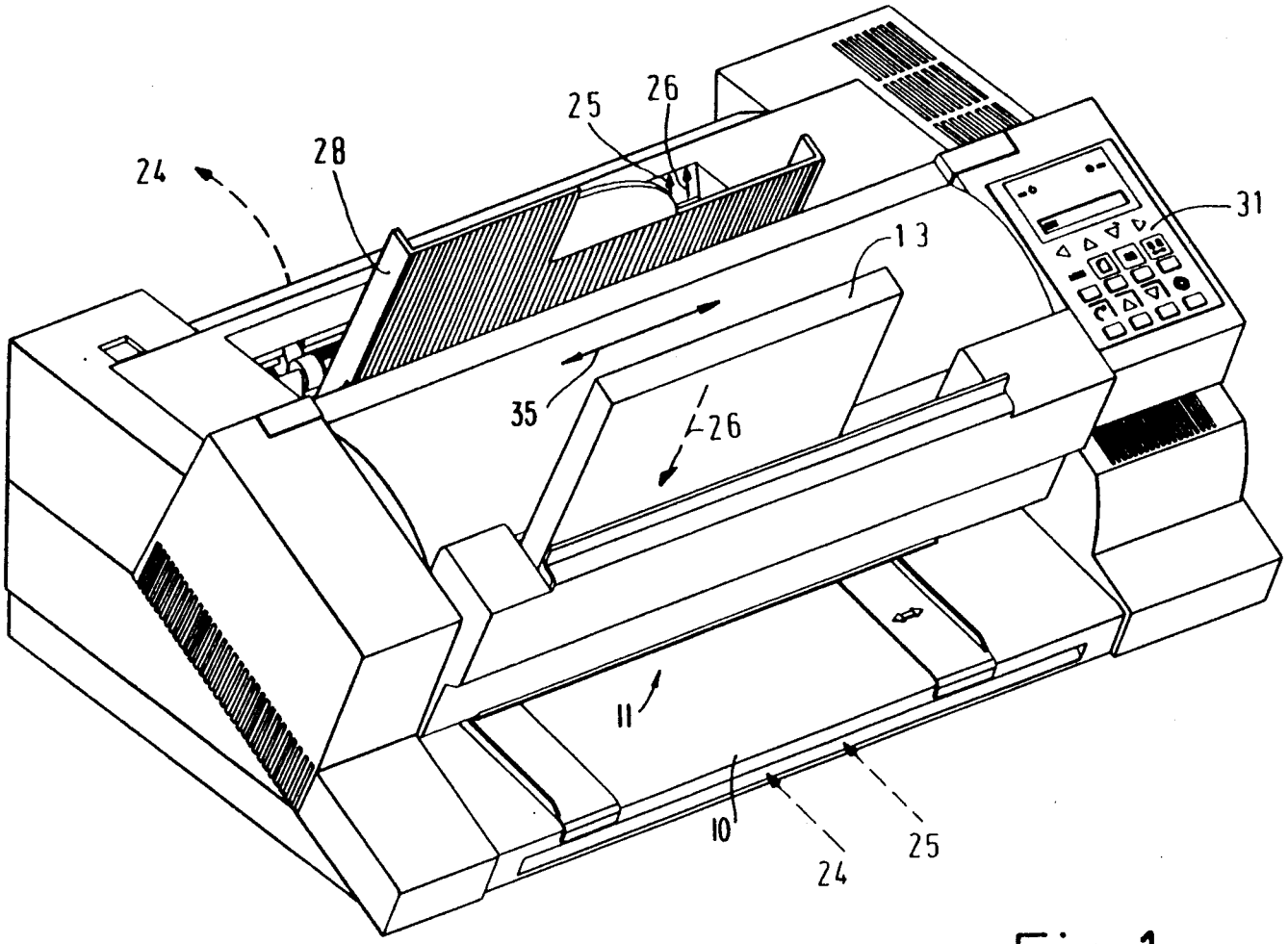
FIG. 1 is a perspective view of a needle printer.
Figure 2:
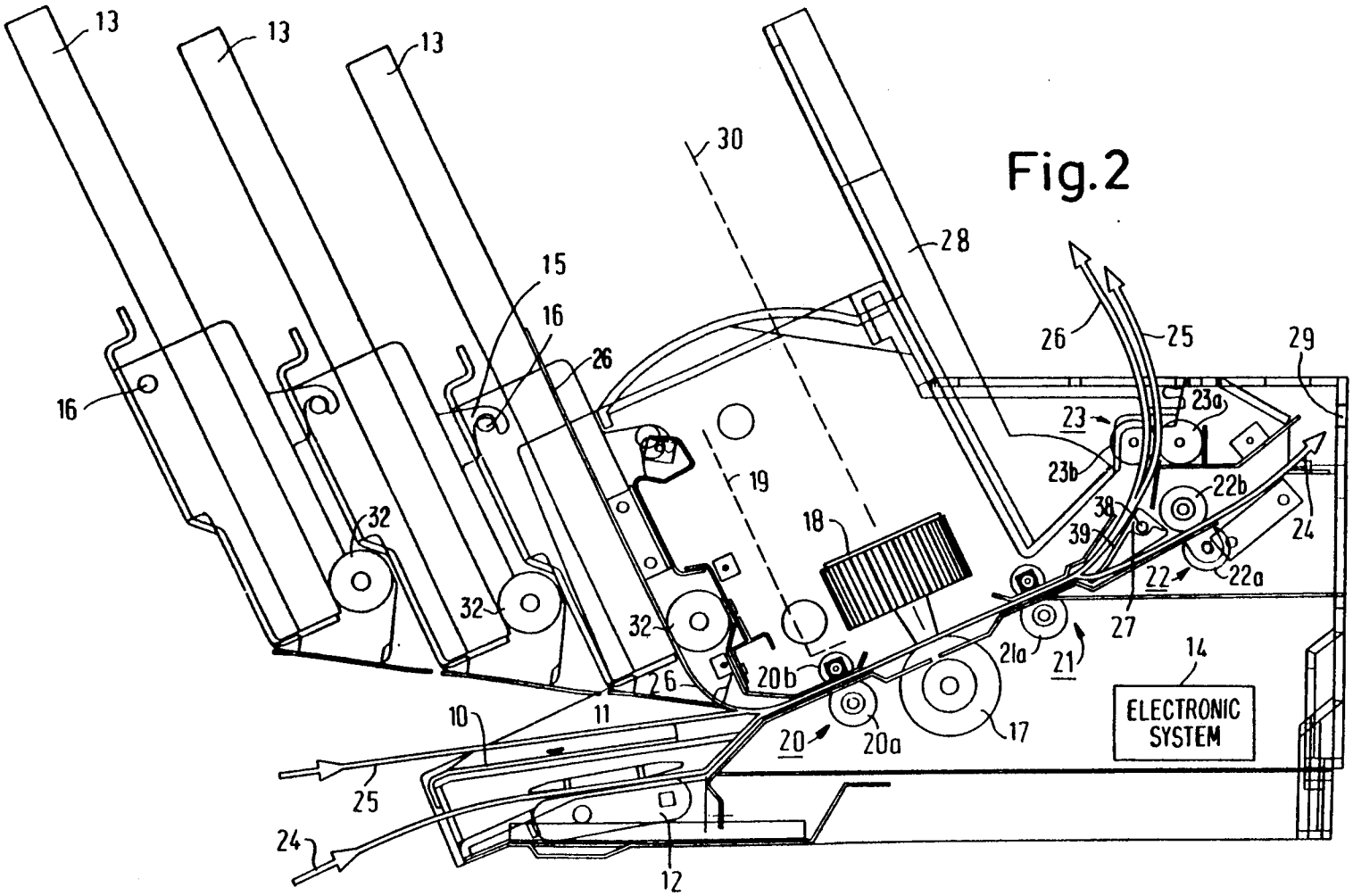
FIG. 2 shows a diagrammatic side elevation of the printer partly in sectional view.

The printer shown in FIGS. 1 and 2 has for feeding separate and endless paper a single feeding region located in the front part. The feeding region has a detachable supporting plate 10 for forming an entrance 11 for manually feeding paper sheets and a tractor 12 arranged under the supporting plate 10 for feeding and transporting endless paper. In FIG. 2, three detachable cassettes 13 for automatically feeding paper sheets are arranged above the entrance 11. The cassettes 13 are separate units having a motor drive, the electrical connections being established by incorporated sliding or clamping contacts. The cassettes are suspended detachably through hooks 15 and nipples 16. Reference numeral 17 designates a printing roller and reference numeral 18 designates a printing head, which is arranged so as to be displaceable in the longitudinal direction on a carriage denoted by reference numeral 19. Reference numerals 20, 21, 22 and 23 designate pairs of rollers, each pair of rollers comprising a driving roller provided with the subscript a and a pressure roller provided with the subscript b. The rollers of each pair are arranged separately beside each other and extend in the longitudinal direction of the printer (normal to the plane of the drawing)"; The paper path for endless paper is designated by reference numeral 24, the path for manually feeding paper sheets is designated by reference numeral 25 and the path for automatically feeding paper sheets is designated by reference numeral 26. By means of a switch 27, which is arranged behind the printing head 18 and is displaceable upon the change-over of the kind of paper, the paper sheets are stacked in a stacker 28 and the endless paper is ejected at an outlet 29, whose upper part takes the form of a tearing edge. The cassettes 13, the stacker 28 and the central axis 30 of the printing head 18 are located in parallel planes. The cassettes 13, the printing head 18 and the stacker 28 are arranged with respect to each other in such a manner that a paper path extending obliquely upwards is obtained. Due to this obliquely ascending paper path, the hindmost space of the printer offers sufficient room for devices, for example the electronic system. FIG. 1 shows on the righthand side the control panel 31.

What is claimed is:

1. A device having a front and a rear region including an operator control panel defining said regions, said device including a printing mechanism including a printing head displaceable along an axis, means including drive rollers for transporting paper sheets, said mechanism including means for transporting endless paper by a tractor, the combination therewith including means for forming a single feed region preceding the printing mechanism relative to said rear region, said feed region for feeding paper sheets and endless paper over a given path through said printing mechanism, said feed region having an entrance for manually feeding paper sheets, said tractor for the transport of endless paper arranged under the entrance for the manual feeding and means for releasably receiving at least one cassette for automatically feeding paper sheets, said at least one cassette being detachably arranged above the entrance and inclined obliquely forward relative to said path.

2. A device as claimed in claim 1 further including a stacker for the paper sheets, said stacker being arranged on the same side of said path as said means for receiving and behind the printing mechanism relative to said latter means and obliquely inclined forward toward said feed region relative to said path.

3. A device as claimed in claim 2 further including a cassette received in said means for receiving, the cassette, the stacker for the paper sheets and the axis of the printing head lying in substantially parallel planes inclined forward toward said feed region relative to said path.

4. A device as claimed in claim 1 including a displaceable paper path switch, which is arranged, viewed in the direction of the paper transport, along said path on the other side of the printing mechanisms relative to the feed region and adapted to switch the paper paths toward separate different paths from said printing head for respective endless paper and paper sheets.

5. A device as claimed in claim 2 including a cassette secured to said means for receiving, said cassette, the stacker and the printing head being arranged with respect to each other in such a manner that paper paths are respectively formed with said stacker and said means for receiving oriented substantially obliquely relative to said given path.

6. A device as claimed in claim 2 including a displaceable paper path switch, which is arranged, viewed in the direction of the paper transport, along said path on the other side of the printing mechanism relative to the feed region and adapted to switch the paper paths towards separate different paths from said printing head for respective endless paper and paper sheets.

7. A device as claimed in claim 3 including a displaceable paper path switch, which is arranged, viewed in the direction of the paper transport, along said path on the other side of the printing mechanism relative to the feed region and adapted to switch the paper paths towards separate different paths from said printing head for respective endless paper and paper sheets.

8. A device as claimed in claim 3 including a cassette secured to said means for receiving, said cassette, the stacker and the printing head being arranged with respect to each other in such a manner that paper paths are respectively formed with said stacker and said means for receiving oriented substantially obliquely relative to said given path.

9. A device as claimed in claim 4 including a cassette secured to said means for receiving, said cassette, the stack and the printing head being arranged with respect to each other in such a manner that paper paths are respectively formed with said stacker and said means for receiving oriented substantially obliquely relative to said given path.

10. A printing apparatus having front and rear sides comprising:

an operator control panel defining said front and rear sides;

a print mechanism including a print head;

drive rollers forming a print head feed path for feeding sheet paper;

a tractor at said front side for feeding endless paper;

means for forming manual sheet, automatic sheet and endless paper entrance feed regions at said front side;

means for positioning the tractor beneath the manual sheet feed entrance region;

means for releasably securing a sheet paper automatic paper feed cassette above said manual sheet feed entrance region and transverse said path; and means for securing a sheet paper stacker substantially parallel to said received cassette at said rear side.

11. The apparatus of claim 10 including path switch means for selectively directing sheet paper to said stacker and endless paper to an exit port in respective different paths from said print mechanism, said exit port lying in a path approximately parallel to said feed path.

12. The apparatus of claim 10 wherein said feed region and said head fed path are generally transverse said received cassette and stacker.

13. A printing apparatus having a front side and a rear side comprising:

an operator control panel defining said front and rear sides;

a printing mechanism;

means including drive rollers for transporting paper sheets;

means for providing a first entrance for manual feeding a paper sheets at said front side;

means for detachably receiving a cassette at said front side for automatically feeding paper sheets to a second entrance; and means including a tractor for transporting endless paper at said front side to a third entrance, each said means being arranged such that all of the entrances feed a common path to said printing mechanism forward of said printing mechanism between said printing mechanism and front side.

14. The apparatus of claim 13 wherein the means for detachably receiving is above the first and third entrances.

15. The apparatus of claim 13 wherein said first entrance is above the third entrance.

16. The apparatus of claim 13 wherein said means for receiving are oriented for receiving the cassette inclined obliquely forward relative to said path.

17. The apparatus of claim 13 further including stacking means for storing sheet paper rearward said printing mechanism.

18. The apparatus of claim 17 wherein said printing mechanism includes a printing head displaceable along a longitudinal direction, said longitudinal direction, means for storing sheet paper and means for receiving being oriented such that the received cassette, stored paper and direction are substantially parallel.

19. The apparatus of claim 13 wherein said drive rollers and printing mechanism define a paper path from said common path oriented obliquely upward and rearward relative to said common entrance.

* * * * *